US008973787B2

(12) United States Patent
Benayas-Perez et al.

(10) Patent No.: US 8,973,787 B2
(45) Date of Patent: Mar. 10, 2015

(54) PORTABLE BEVERAGE-DISPENSING DEVICE FOR USE BY GROUPS

(76) Inventors: Luis Benayas-Perez, Madrid (ES); Javier Perez Perez, Boadilla del Monte (ES)

( * ) Notice: Subject to any disclaimer, the term of this patent is extended or adjusted under 35 U.S.C. 154(b) by 0 days.

(21) Appl. No.: 13/384,145

(22) PCT Filed: Jul. 15, 2010

(86) PCT No.: PCT/ES2010/070493
§ 371 (c)(1),
(2), (4) Date: Mar. 26, 2012

(87) PCT Pub. No.: WO2011/007042
PCT Pub. Date: Jan. 20, 2011

(65) Prior Publication Data

US 2012/0175013 A1 Jul. 12, 2012

(30) Foreign Application Priority Data

Jul. 17, 2009 (ES) ..... 200930475

(51) Int. Cl.
*B67D 3/00* (2006.01)
*F25D 3/08* (2006.01)

(52) U.S. Cl.
CPC ..... *B67D 3/0009* (2013.01); *B67D 3/0029* (2013.01); *B67D 3/0083* (2013.01); *B67D 2210/00068* (2013.01); *F25D 3/08* (2013.01); *F25D 2331/806* (2013.01)
USPC ..... 222/146.6; 222/185.1; 222/501; 222/514

(58) Field of Classification Search
CPC ..... F16K 3/00
USPC ..... 222/146.6, 481, 540, 421, 482, 510, 222/518, 506, 522, 153.09, 162, 181.3, 180, 222/181.1, 501, 505, 185.1, 514, 153.01, 222/186, 402.1; 141/35, 99, 234, 236, 237, 141/243, 302, 392; 62/389, 390, 393, 398, 62/400, 430, 457.2; 220/592.01, 592.16, 220/592.18, 662; 215/366
See application file for complete search history.

(56) References Cited

U.S. PATENT DOCUMENTS 128,956 A * 7/1872 Fellows ..... 222/131
308,058 A * 11/1884 Carter ..... 62/319

(Continued)

FOREIGN PATENT DOCUMENTS

ES 2121506 A 11/1998
WO 9500434 A 1/1995

OTHER PUBLICATIONS

International Search Report Application No. PCT/ES2010/070493, dated Nov. 18, 2010.

*Primary Examiner* — Kevin P Shaver
*Assistant Examiner* — Michael J Melaragno
(74) *Attorney, Agent, or Firm* — Nutter McClennen & Fish LLP; John J. Penny, Jr.; Derek P. Roller

(57) ABSTRACT

The dispensing device (1) has a beverage receptacle (2) with holes (200) in the base thereof, said holes being stopped with valves (3); a supporting base (4) that supports the receptacle; serving mechanisms (5) for opening the valves; and a cooling element mounted between the receptacle and the stand. The base (20) of the receptacle has, within, a convex central portion (201) and a peripheral portion (202) with the emptying holes, and the outer part thereof has a concave central portion (203) and a peripheral zone (204) with housings (205) for mounting a respective valve. The stand has an upper portion (40) in which the receptacle fits, and supporting legs (41). The serving mechanisms (5) are mounted in the upper portion of the stand, operationally facing the respective valve. The cooling element (6) is designed to be fitted inside the upper portion of the stand, with the base of the receptacle located above said element.

2 Claims, 8 Drawing Sheets

(56) References Cited

U.S. PATENT DOCUMENTS

| | | | | | |
|---|---|---|---|---|---|
| 547,385 | A | * | 10/1895 | Shepard | 220/592.16 |
| 901,433 | A | * | 10/1908 | Fox | 62/246 |
| 912,281 | A | * | 2/1909 | Brunner et al. | 222/131 |
| 1,006,475 | A | * | 10/1911 | Gardner | 220/569 |
| 1,081,350 | A | * | 12/1913 | Viney | 165/109.1 |
| 1,086,425 | A | * | 2/1914 | Viney | 165/74 |
| 2,088,376 | A | * | 7/1937 | Kaskey | 366/256 |
| 2,261,276 | A | * | 11/1941 | Patterson | 62/392 |
| 2,289,645 | A | * | 7/1942 | Geistert | 62/68 |
| 2,570,283 | A | * | 10/1951 | Stevens | 222/132 |
| 2,658,648 | A | * | 11/1953 | Tribbitt | 222/477 |
| 2,910,219 | A | * | 10/1959 | Bennett et al. | 220/737 |
| 3,269,606 | A | * | 8/1966 | Armstrong | 62/392 |
| 4,440,321 | A | * | 4/1984 | Campbell et al. | 222/153.01 |
| 4,505,409 | A | * | 3/1985 | Armstrong | 222/509 |
| 4,608,837 | A | * | 9/1986 | Hickey et al. | 62/400 |
| 4,635,824 | A | * | 1/1987 | Gaunt et al. | 222/129.1 |
| 4,711,374 | A | * | 12/1987 | Gaunt et al. | 222/129.1 |
| 5,351,861 | A | * | 10/1994 | Jovellana | 222/144 |
| 5,788,840 | A | * | 8/1998 | Lee et al. | 210/435 |
| 5,791,517 | A | * | 8/1998 | Avital | 222/1 |
| 5,890,629 | A | * | 4/1999 | Loew | 222/144.5 |
| 6,047,866 | A | * | 4/2000 | Brown | 222/608 |
| 6,089,519 | A | * | 7/2000 | Laybourne | 248/346.11 |
| 6,279,210 | B1 | * | 8/2001 | Faass et al. | 24/457 |
| 6,601,736 | B2 | * | 8/2003 | Ophardt et al. | 222/181.1 |
| 6,634,827 | B2 | * | 10/2003 | Quinn et al. | 403/329 |
| 6,708,741 | B1 | * | 3/2004 | Berry et al. | 141/362 |
| D499,598 | S | * | 12/2004 | Guadalupi | D7/306 |
| D505,823 | S | * | 6/2005 | Turner | D7/307 |
| 7,182,222 | B2 | * | 2/2007 | Prabucki | 222/146.6 |
| 7,328,818 | B2 | * | 2/2008 | Prabucki | 222/146.6 |
| 7,350,671 | B2 | * | 4/2008 | Mika et al. | 222/129 |
| D585,693 | S | * | 2/2009 | Wright | D7/309 |
| 7,490,739 | B2 | * | 2/2009 | Prabucki | 222/146.6 |
| D637,039 | S | * | 5/2011 | Schreiber-Pethan et al. | D7/403 |
| D655,562 | S | * | 3/2012 | Schenk | D7/307 |
| 8,413,855 | B2 | * | 4/2013 | Ophardt et al. | 222/321.8 |
| 2006/0191284 | A1 | * | 8/2006 | Fuller | 62/389 |
| 2006/0249538 | A1 | * | 11/2006 | Ophardt et al. | 222/181.3 |
| 2006/0283883 | A1 | * | 12/2006 | Mika et al. | 222/129 |
| 2007/0131716 | A1 | * | 6/2007 | Prabucki | 222/146.6 |
| 2007/0187435 | A1 | * | 8/2007 | Quirk | 222/481 |
| 2007/0277547 | A1 | * | 12/2007 | Veeravagu et al. | 62/396 |
| 2009/0026229 | A1 | * | 1/2009 | Laible | 222/442 |
| 2009/0126394 | A1 | * | 5/2009 | Krog | 62/399 |
| 2011/0240680 | A1 | * | 10/2011 | Ophardt et al. | 222/321.8 |

* cited by examiner

PORTABLE BEVERAGE-DISPENSING DEVICE FOR USE BY GROUPS

SCOPE AND PRIOR ART

The present invention relates in general to a portable device or apparatus to distribute drinks collectively applicable in the hotel industry equipment sector, such as bars, restaurants and such like, but it can even be used for domestic purposes.

Document ES 2121506 discloses a dispenser device with a drink receptacle equipped with an emptying orifice in its bottom which is obturated with a valve; a support to securely but demountably hold the drink receptacle; and a tap which serves to open the valve of the drink receptacle and allow the exit of the liquid. But this device is not adapted to dispense drink simultaneously to several users nor is it provided with means to keep the drink at a suitable temperature.

Document WO95/00434 discloses a drink dispenser device which also has drink receptacle with an emptying orifice in its bottom and a tap connected to the receptacle to dispense the liquid contained, being additionally provided to have inside the drink receptacle a cooling element, disposed in bag that is in direct contract with the drink. Neither is this device adapted to dispense drink simultaneously to several users and the bag containing the cooling element is in direct contact with the drink to be dispensed so that there is a potential risk of contamination of the drink with germs and unsuitable substances and so that, furthermore, the material forming the bag may alter the taste of the drink contained.

OBJECT OF THE INVENTION

Starting from the aforementioned state of the art, the invention's objective is the development of a device of the type indicated at first adapted to the simultaneous serving of drink to several users and which has a cooling element which is not in direct contact with the drink.

This objective is achieved through the characteristics indicated in claim 1 which includes a preamble with the characteristics of the prior art. Other objectives and advantages of the invention are achieved through the characteristics indicated in the dependent claims.

In accordance with the invention the drink dispenser is provided with a support base where a receptacle for containing drinks by way of a glass is engaged, which has emptying orifices in its bottom obturated by respective valves. Mounted in said support base, protruding through its lower part and angularly equidistant, nozzles are disposed for the exit of the drink, for example three nozzles equidistant at 120°, and conveniently located and centred on them, respective pouring levers in the form of a handle each of which on being independently actuated move sliding parts vertically upward which drag said nozzles, displacing, in said vertical movement the valves located in the bottom of the receptacle, causing their opening and the consequent exit of the drink through the nozzles. When the pressure on the pouring lever stops, the corresponding sliding part and the respective valve are returned to their initial position by springs provided for said purpose, cutting off the drink supply.

The dispenser has a cooling element in the form of a block which is adapted to the shape of the inner part of the support base and of the lower part of the drink receptacle and filled of cooling gel which can freeze placed between the support base and the drink receptacle in order to keep this suitable cool.

This assembly is finished in its upper part by a lid situated on the drink receptacle in order to protect the drink and it has in its lower part a tray on which legs provided on the support base rest and engage and enable the collection of wasted water and the support of glasses and jugs during the use of the dispenser.

The drink receptacle, preferably of transparent material, is configured with a semi-triangular base and a cylindrical opening and has in its bottom angularly equidistant cylindrical emptying orifices, for example three orifices equidistant at 120°, wherein are housed respective valve bodies which, equipped with a toric seal and spring, cause its obturation. Said bottom has a convex shape to favour the exit of liquids. In the lower part it has an area for its engaged and demountable coupling on the support base, configured with crenellated protuberances, for example, three equidistant at 120°, in the inner wall to guarantee it is secured.

The support base is supported by legs, for example, three angularly equidistant at 120°, and in which upper part rests perimetrically engaged the drink receptacle, having in its inner perimeter blocking parts, for example three situated angularly equidistant at 120° and which are mounted in respective housings provided for this purpose; these blocking parts which are actuated by a spring, have the purpose of securing and blocking the drink receptacle against an undesired removal. In the bottom of the support base, is mounted an unblocking disk, which remains at rest via a spring and which has arms, for example, three angularly equidistant at 120°, which have an end suitably configured to act as cam on the blocking parts and protuberances in the form of appendage on its lower part which crossing the bottom protrude therefrom and can be manually pressed from the outside for the release of the drink receptacle.

Furthermore, the support base has housings, for example three angularly equidistant at 120°, to house the outlet nozzles and centred with respect to them, another three housings with the suitable form for the fastening and assembly of the pouring levers.

Each pouring lever has a support where the sliding part is housed, adapted to hook with the outlet nozzles mounted in the support base, each sliding part being provided to move vertically upward on actuating the respective pouring lever which pivots in an axis housed in said support. The recovery of the mechanism is performed by two springs that act on the sliding part once the assembly is conveniently secured in housings disposed in the support base.

BRIEF DESCRIPTION OF THE DRAWINGS

Other characteristics and advantages of the invention will be clearer from the following description made with the aid of the attached drawings, referring to an example of non-limitative embodiment and wherein.

DETAILED DESCRIPTION OF A PREFERRED EMBODIMENT

Figure 1:
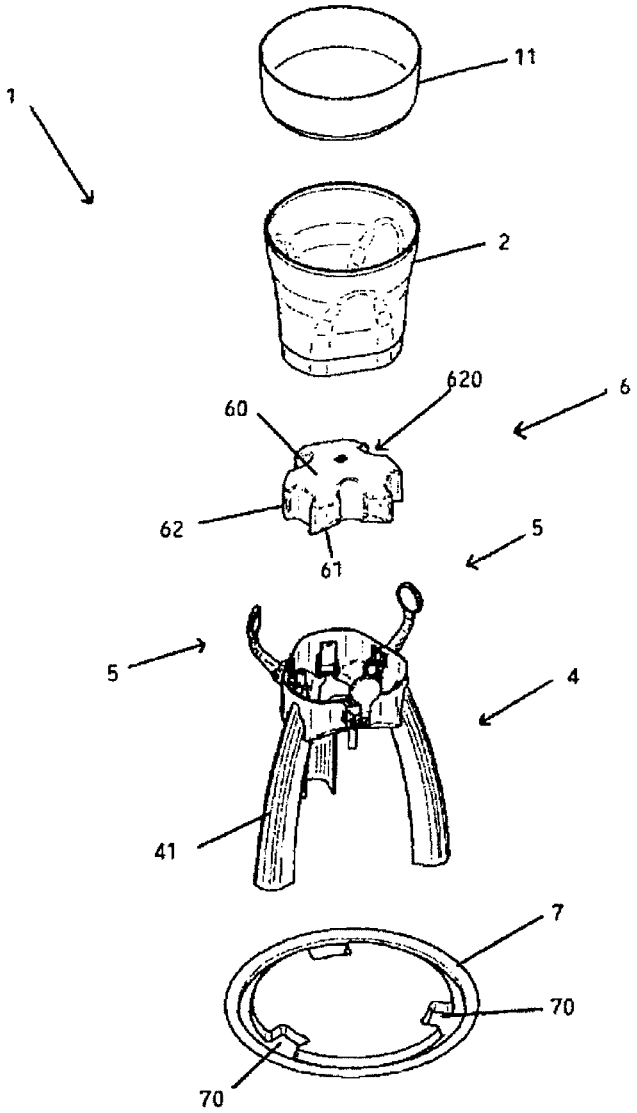
FIG. 1 is an exploded perspective view of a dispenser device in accordance with the invention.
Figure 2:
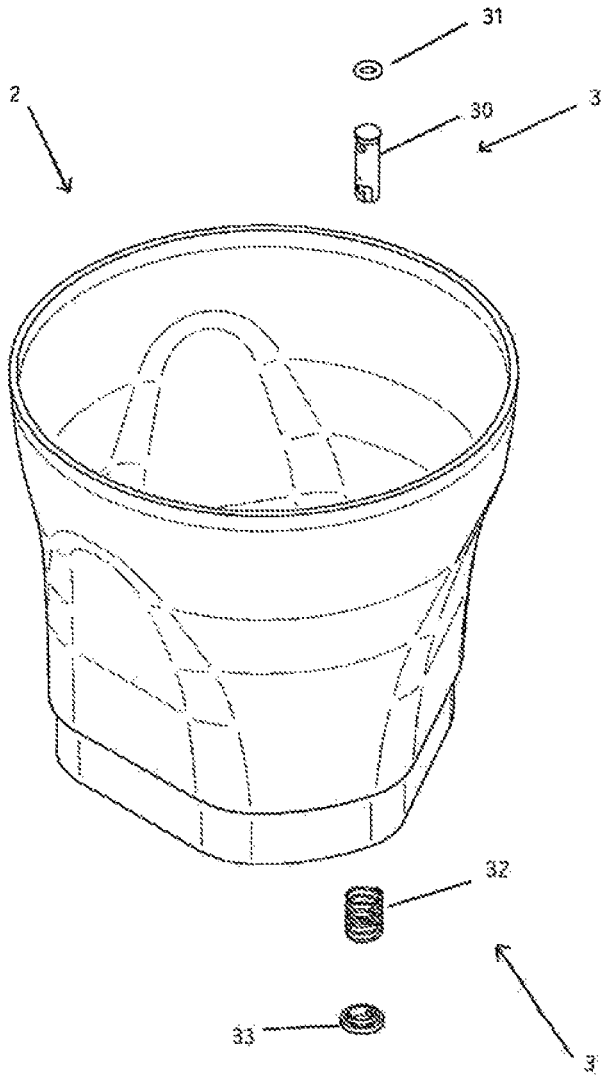
FIG. 2 illustrates a perspective view of the drink container of the dispenser with exploded detail of its cut-off values.
Figure 3A:
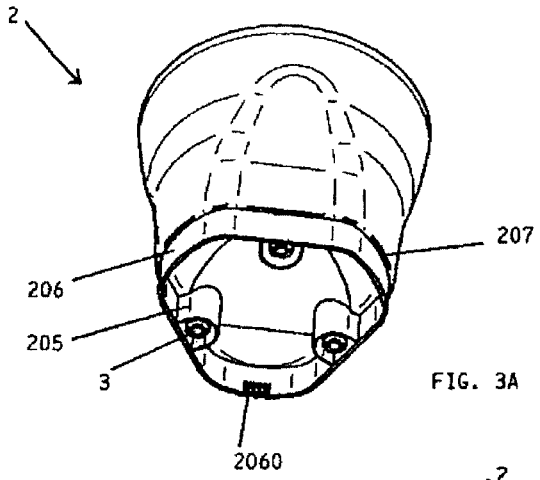
FIGS. 3A to 3C and 4 show respective lower perspective views, upper and lower plan and an elevation view of the drink container of FIG. 2.
Figure 3B:
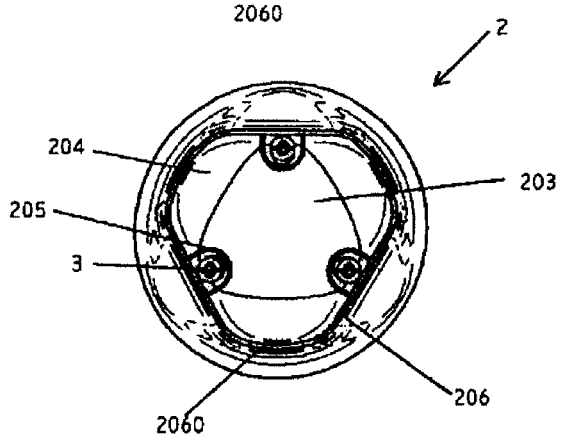
Figure 3C:
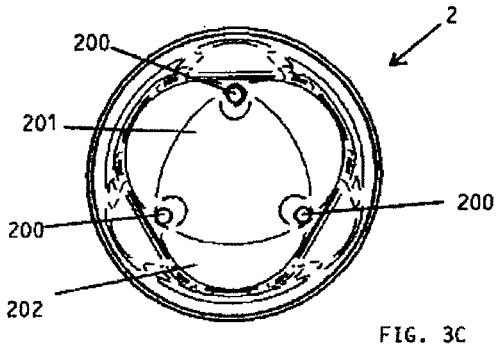
Figure 4:
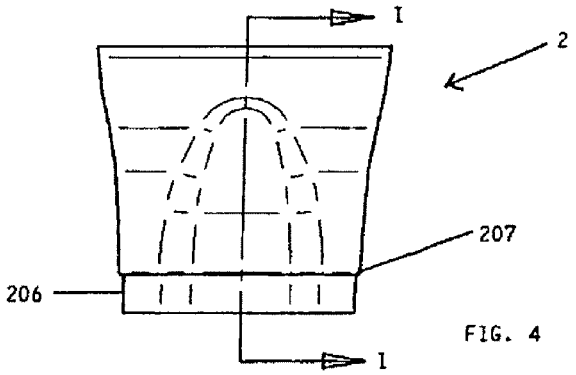
Figure 5:
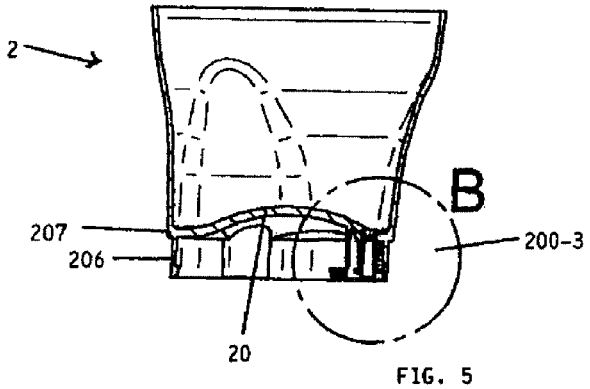
FIGS. 5 and 6 respectively illustrate a cross-section of the drink container along line I-I of FIG. 4 and an enlargement of said section.
Figure 6:
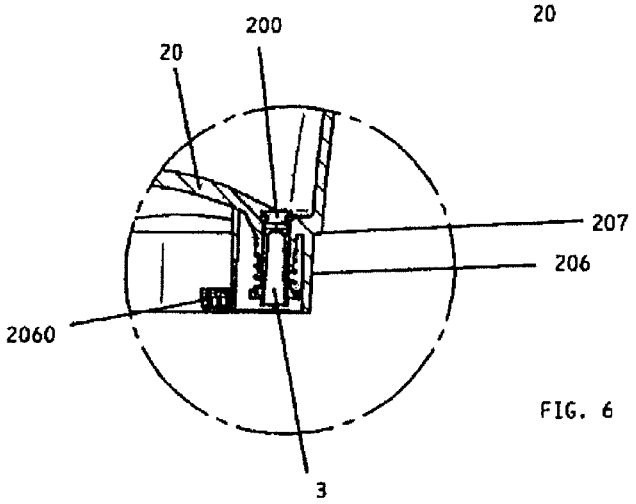
Figure 7:
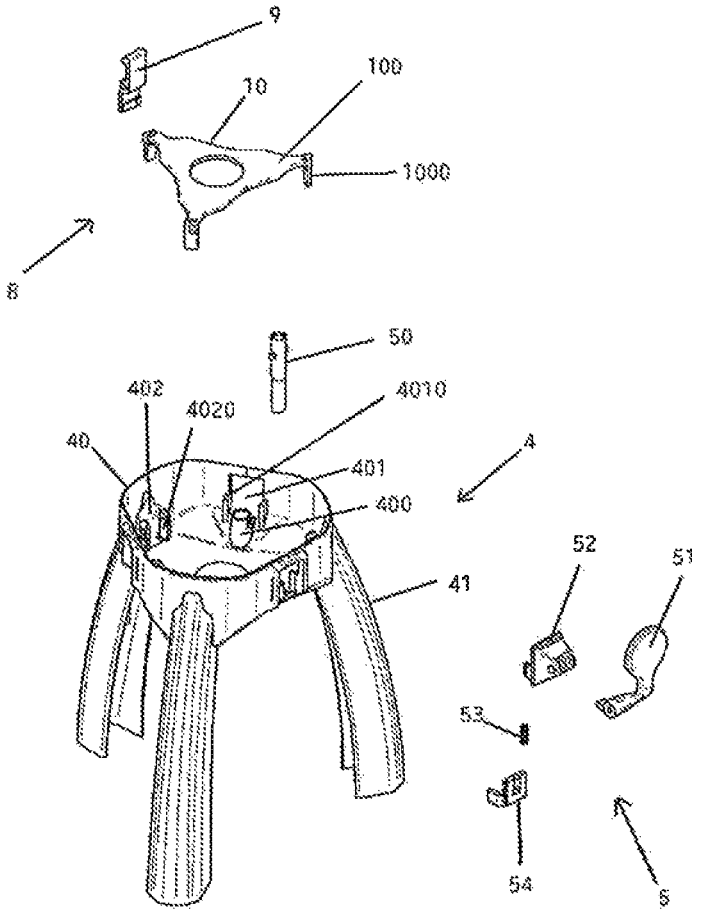
FIG. 7 shows an exploded perspective view of the support base of the dispenser device according to the invention.
Figure 9:
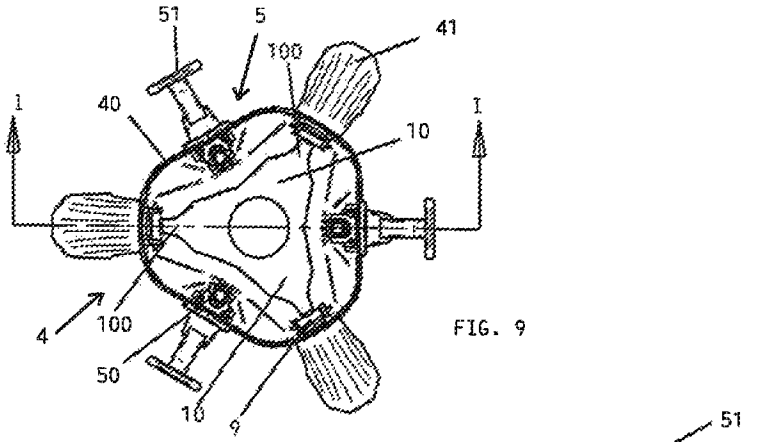
FIGS. 8 and 9 show respective perspective and plan views of the support base of the dispenser device according to the invention.
Figure 10:
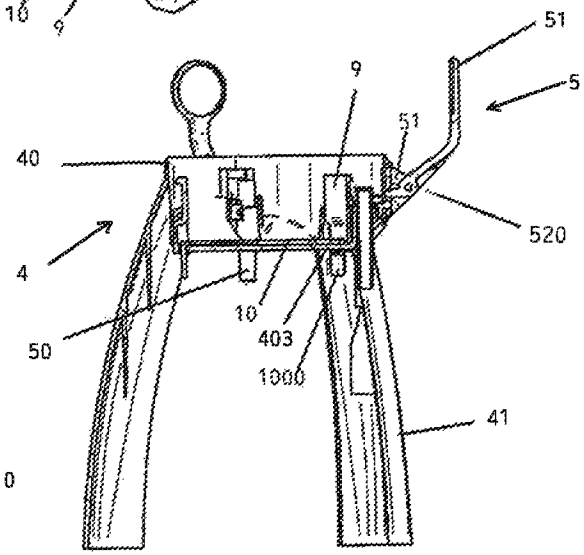
FIG. 10 illustrates a sectional view of the support base of the dispenser device along line I-I of FIG. 9.
Figure 8:
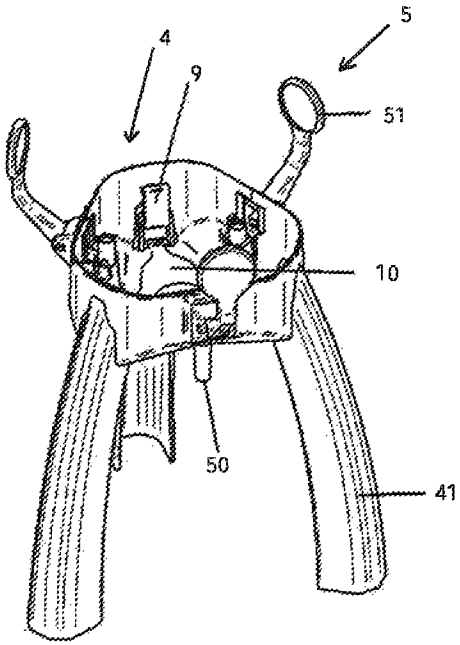
Figure 11:
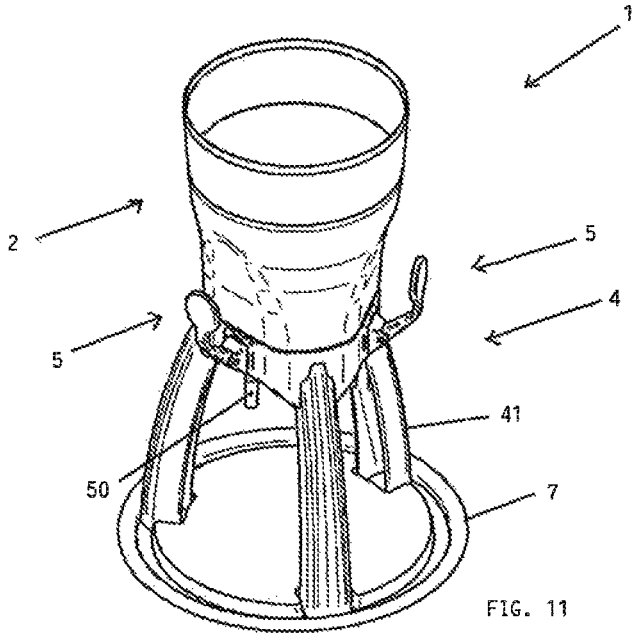
FIG. 11 shows a perspective view of a dispenser device in accordance with FIG. 1 but assembled.
Figure 12:
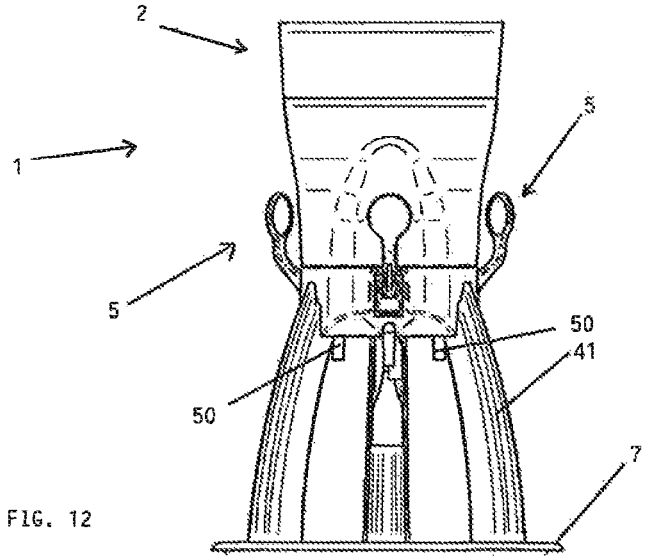
FIGS. 12 and 13 illustrate respective elevation and plan views of the dispenser device according to FIG. 11.
Figure 13:
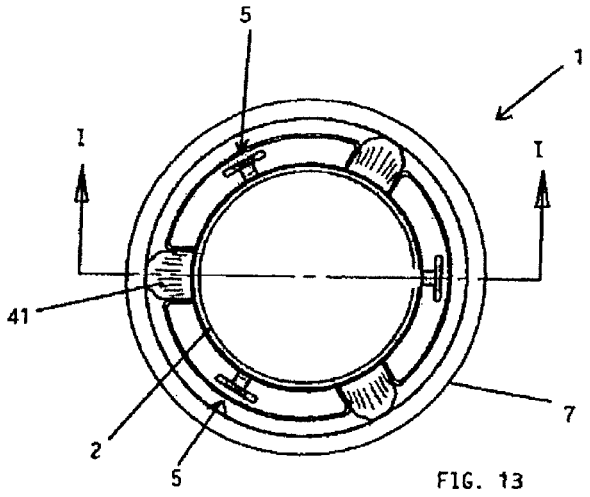
Figure 14:
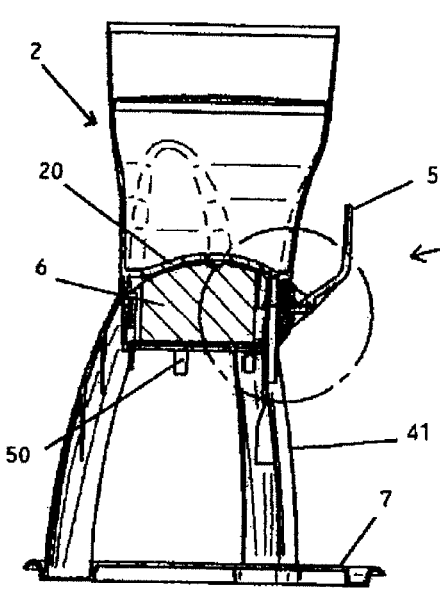
FIGS. 14 and 15 show respectively a section through line I-I of FIG. 13 and an enlargement of said cut.
Figure 15:
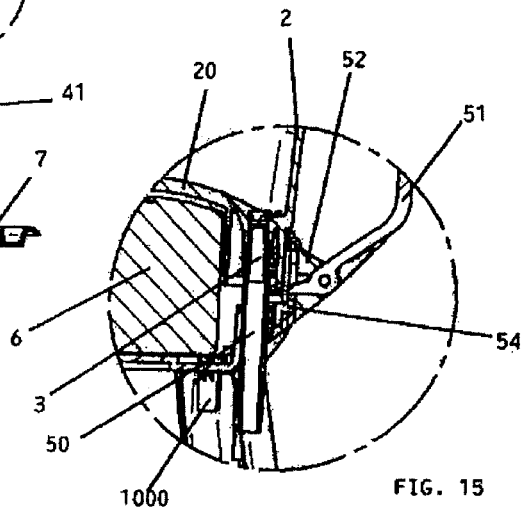

As can be seen through the drawings, the dispenser device in accordance with the invention designated in general by reference 1, comprises a drink receptacle 2 with valves 3 in its bottom, a support base 4 for supporting the drink receptacle, pouring mechanisms 5 that serve to open the valves 3 and a cooling element 6 which is mounted inside the support base under the drink receptacle.

It can be seen that the drink receptacle 2 has a bottom 20 configured in its inner part with a convex central portion 201 surrounded by a perimeter portion 202 wherein are provided a plurality of angularly equidistant emptying orifices 200. Furthermore, the outer part of the bottom 20 is configured with a central area 203 surrounded by a perimeter area 204 wherein are provided cylindrical housings 205 in the form of a bushing aligned with the emptying orifices 200 and in which cylindrical housings are engaged the respective valve 3.

Additionally, this drink receptacle 2 has configured in its lower part a perimeter flange 206 and a support edge 207, which serve to rest on the support 4 as will be described in detail below. Furthermore, in the inner part of the perimeter flange 206 are provided crenellated ribs 2060 disposed angularly equidistant as will be described below for coupling with blocking against undesired removal of the drink receptacle.

The valves 3, known in themselves, consist of a valve body 30 and a valve spring 32 and each one of these cut-off valves mounted on the orifices 200 and engaged in the cylindrical housings 205 of the lower part of the container 2 with the aid of a valve gasket 31 and a valve bushing 33.

As shown in the drawings, the support base 4 is provided with an upper portion 40 in the form of bowl with a configuration complementary to that of the base of the drink receptacle for the engaging of said drink receptacle thanks to the aforementioned perimeter flange 206 and support edge 207; furthermore, in the upper portion 40 of this support 4 are provided openings 401 for mounting of the pouring mechanisms 5 as will be explained in detail below.

Additionally, said support has support legs 41 that extend from its upper portion 40. It can also be provided with a support platform 7 in the form of a tray with housings 70 wherein the support legs 41 of the support 4 engage so that they provide a surface under the support that can serve for placing cups or glasses for the drink served which are not represented, which also serve for collecting waste which may be generated during dispenser use.

It can be seen that the pouring mechanisms 5 are mounted on the upper portion 40 of the support base 4 to operationally face the respective valve 3 for its actuation.

As additionally represented in the drawings, there pouring mechanisms 5 are mounted angularly equidistant on the support base 4, each one of them having a pouring lever 51 mounted with possibility of upward and downward movement on the upper portion 40 of the support base and a nozzle 50 for liquid exit mounted in a housing 400 in the form of bushing correspondingly provided inside said upper portion of said support base. As shall be explained in more detail later, the outlet nozzle 50 is mechanically coupled to the pouring lever 51 so that with the downward movement of the lever, the outlet nozzle moves vertically upward opposing the respective valve 3 opening it and displacing it downward separating from said valve which is closed when the pouring lever moves upward.

The drawings also show that each pouring mechanism 5 is provided with a lever support 52 wherein is mounted a spin axis 520 for the pouring lever 51, a helicoidal spring 53 and a sliding part 54 which is mounted through a respective opening 401 correspondingly provided in the upper portion 40 of the support base 4 and a pair of guides 4010 for the sliding part being associated to each opening 401 and said sliding part being operationally coupled to an outlet nozzle 50. In this way, by moving the pouring lever 51 downward it will pivot around the spin axis 520 moving the sliding part upward 54 which drags the outlet nozzle upward 50 until it presses against the respective valve 3 opening it; the helicoidal spring 53 serves to put back the nozzle 50, the slide 54 and the pouring lever 51 to their initial raised position.

As can be seen in the drawings, in the upper portion 40 of the support base 4 is provided a blocking-unblocking device 8 of the drink receptacle 2 and which in blocked position prevents the removal of said drink receptacle from its engagement in the support base 4 and which in its unblocked position releases the drink receptacle allowing its removal from said support base.

As shown in the figures, this blocking-unblocking device 8 is formed by respective blocking pieces 9 disposed to be operationally faced and be coupled to the crenellated ribs 2060 provided inside the perimeter flange 206 of the lower part of the drink container 2 and an unblocking part 10 that can be actuated from the outside to actuate on the blocking parts 9 as will be explained in detail below.

It can be seen that the blocking parts 9, tightened due to a spring, not represented, are mounted mobile on ribs 4020 provided on a respective additional opening 402 correspondingly made in the upper portion 40 of the support base 4.

It can also be seen that the unblocking part 10, tightened due to a spring, not represented, is provided as a disk with arms 100 configured at its end to actuate by way of a cam on the blocking parts 9 and each end of the respective arm having an appendage 1000 which extends downward to protrude through an opening 403 made in the bottom of the upper portion 40 of the support base 4, so that said appendages can be manually pressed from the outside to remove the blocking parts 9 of its engagement in the crenellated ribs 2060 of the lower part of the drink container and thus release this drink receptacle from its engagement in the support base.

As shown in the drawings, the cooling element 6 is removably housed inside the upper portion 40 of the support 4 so that it can be replaced by another suitably cooled one. As known, the cooling element is filled with cooling gel that can be frozen.

It can be seen that this cooling element 6 has general cylindrical configuration with a convex upper base 60, an essentially flat lower base 61 and a side wall 62 with recesses 620. In this way, when this cooling element 6 is mounted in the dispenser device 1, the concave central portion 203 of the outer part of the bottom 20 of the drink receptacle 2 rests against its convex upper base 60, its lower base 61 rests against the bottom of the upper portion 40 of the support base and the recesses 620 of its side wall 62 adapt to the internal configuration of said upper portion 40 of the support 4.

In order to protect the drink contained in the receptacle 2, as can be seen in FIG. 1, a lid 11 is provided for the upper opening of the receptacle.

As will be easily understood by people skilled in the art, the aforementioned is merely illustrative of a preferred embodiment of the invention so that technical modifications of any kind are possible which means that the embodiments arising from changes in shape, dimensions and such like, as well as those resulting from application of the above disclosed, must be included in its scope, so that the invention will only be limited by the scope of the following claims.

The invention claimed is:

1. An improved portable drink dispensing device for collective use comprising:

a drink receptacle having a plurality of liquid emptying orifices formed in an inner bottom surface thereof that are each obturated with a valve;

a support base to demountably secure the drink receptacle;

a plurality of pouring mechanisms that serve to open the valves of the drink receptacle; and a removable cooling element capable of cooling fluid within the drink receptacle, wherein the inner bottom surface of the drink receptacle includes a convex central portion surrounded by a flat outer portion, wherein the liquid emptying orifices are positioned in the flat outer portion and angularly equidistant from one another, an outer bottom surface of the drink receptacle having a concave central area and a perimeter area that includes a plurality of cylindrical housings that are aligned with the liquid emptying orifices and configured to engage the valves;

the support base includes an upper portion shaped to receive a lower portion of the drink receptacle, the lower portion of the drink receptacle including a perimeter flange and a support edge that are received within the upper portion of the support base, the support base additionally has a plurality of support legs that extend from the upper portion;

the plurality of pouring mechanisms are mounted angularly equidistant on the support base, each one of the plurality of pouring mechanisms having a pouring lever that can move upward and downward relative to the upper portion of the support base and a nozzle for liquid exit mounted in a housing on an inner surface of the upper portion of the support base, the nozzle being mechanically coupled to the pouring lever so that downward movement of the pouring lever results in upward movement of the nozzle into a valve opening to release liquid from the drink receptacle;

each of the plurality of pouring mechanisms is provided with a lever support wherein a spin axis for the pouring lever is mounted, a helicoidal spring and a sliding part are mounted through an opening provided in the upper portion of the support base and a pair of guides extends along opposed sides of each opening to allow for the sliding part and the lever support to be operationally coupled to the nozzle, so that downward movement of the pouring lever relative to the support base causes the lever support to pivot around the spin axis and move the sliding part upward which drags the nozzle upward to press against the respective valve opening and the helicoidal spring serves to return the nozzle, the sliding part, and the pouring lever to an initial position;

the cooling element is demountably fixed within the upper portion of the support base and has a generally cylindrical shape with a convex upper surface that rests against the concave central area of the outer bottom surface of the drink receptacle, a flat lower surface that rests on a bottom surface of the upper portion of the support base, and an outer side wall with a plurality of semi-circular recesses formed therein to complement the interior shape of the upper portion of the support base and, in combination with the perimeter flange of the drink receptacle, surround each nozzle of the plurality of pouring mechanisms;

the upper portion of the support base includes a blocking-unblocking device which, in a blocked position, prevents the removal of the drink receptacle from the support base and, in an unblocked position, releases the drink receptacle to allow removal from the support base; and wherein the blocking-unblocking device includes a plurality of blocking pieces configured to couple to crenelated projections formed on an inside surface of the perimeter flange of the lower portion of the drink receptacle and an unblocking part configured to be actuated from outside the support base to act on the plurality of blocking pieces.

2. A dispenser device in accordance with claim 1, wherein each of the plurality of blocking pieces are mounted mobile on ribs provided on opposing sides of a second opening formed in the upper portion of the support base, the unblocking part being a disk with a plurality of arms, an end of each arm being configured to abut against one of the plurality of blocking pieces and the end of each arm including an appendage which extends downward to protrude through a third opening made in the bottom surface of the upper portion of the support base, so that the appendages can be manually pressed from outside the support base to move the plurality of blocking pieces away from the crenelated projections of the drink receptacle and thereby release the drink receptacle from the support base.

* * * * *